United States Patent [19]

Ruiz et al.

[11] Patent Number: 4,606,795

[45] Date of Patent: Aug. 19, 1986

[54] METHOD FOR SPOT PLATING FLATWARE

[75] Inventors: Raul Ruiz, Monterey Park; Gary P. Stein, Beverly Hills, both of Calif.

[73] Assignee: Specific Plating Co., Inc., City of Commerce, Calif.

[21] Appl. No.: 768,969

[22] Filed: Aug. 23, 1985

[51] Int. Cl.[4] ..... C25D 5/02

[52] U.S. Cl. ..... 204/15

[58] Field of Search ..... 204/15

[56] References Cited

U.S. PATENT DOCUMENTS 4,385,968 5/1983 Gaston ..... 204/15

*Primary Examiner*—T. M. Tufariello

*Attorney, Agent, or Firm*—Gene W. Arant

[57] ABSTRACT

A method of spot gold plating a metallic flatware article by placing the article in a horizontal position resting upon a metallic cathode and a metallic mesh anode. The metallic mesh anode is filled with an aqueous gold plating solution before a D.C. voltage is applied between the anode and cathode.

2 Claims, 9 Drawing Figures

METHOD FOR SPOT PLATING FLATWARE

BACKGROUND OF THE INVENTION

In the manufacture of eating utensils such as flatware it is most economical to make each article as a solid metal piece. For example, knives, forks, and spoons can be integrally formed from stainless steel at low cost, and have a long useful life as well as being reasonably attractive in appearance.

It is most desirable, however, to be able to add decoration to the appearance of these items. One way to do that is to add spots of a decorative plating, such as gold plating.

In the spot plating of flatware it has not hitherto been known how to accomplish the process in a truly efficient and economical manner. The known technique has involved re-plating the entire utensil, and then removing the new plating from all surfaces except the selected surfaces on which it was to remain.

SUMMARY OF THE INVENTION

According to the present invention the article of flatware to be spot plated is placed upon a special fixture that is specially adapted for that purpose. The fixture has at least one upwardly facing metallic cathode and at least one upwardly facing metallic mesh anode, as well as guide means for aligning the flatware article in a predetermined position. The metallic mesh anode is filled with a plating solution that will provide the decorative finish. A D.C. voltage is applied between the cathode and the anode. Then the article of flatware is placed upon the fixture, in contact with both cathode and anode, for a selected period of time. The article is then removed from the fixture, any excess plating solution is washed from it, and the metallic mesh anode is refilled with plating solution to prepare it to receive the next article. In this manner a fast and efficient production process is achieved.

According to one preferred form of the invention, a fast plating solution is used, which applies the spot plating in a very brief period of time. In order to avoid over-plating and discoloration of the plated area it is then the practice in accordance with the present invention to impart a horizontal reciprocating movement to the article of flatware while it is in contact with the electrodes.

In accordance with the invention it is generally preferred to spot plate a decorative finish on two or more separate areas of the flatware or other article to be plated. The approach is then to select a fixture having two or more separate metallic mesh anodes with suitable horizontal spacing between them. The article to be plated is then placed upon the fixture and all areas are spot plated at the same time.

DRAWING SUMMARY

DESCRIPTION OF APPARATUS

(FIGS. 1–6)

The presently preferred apparatus of the invention will now be described with reference to FIGS. 1–6, inclusive.

Figure 1:
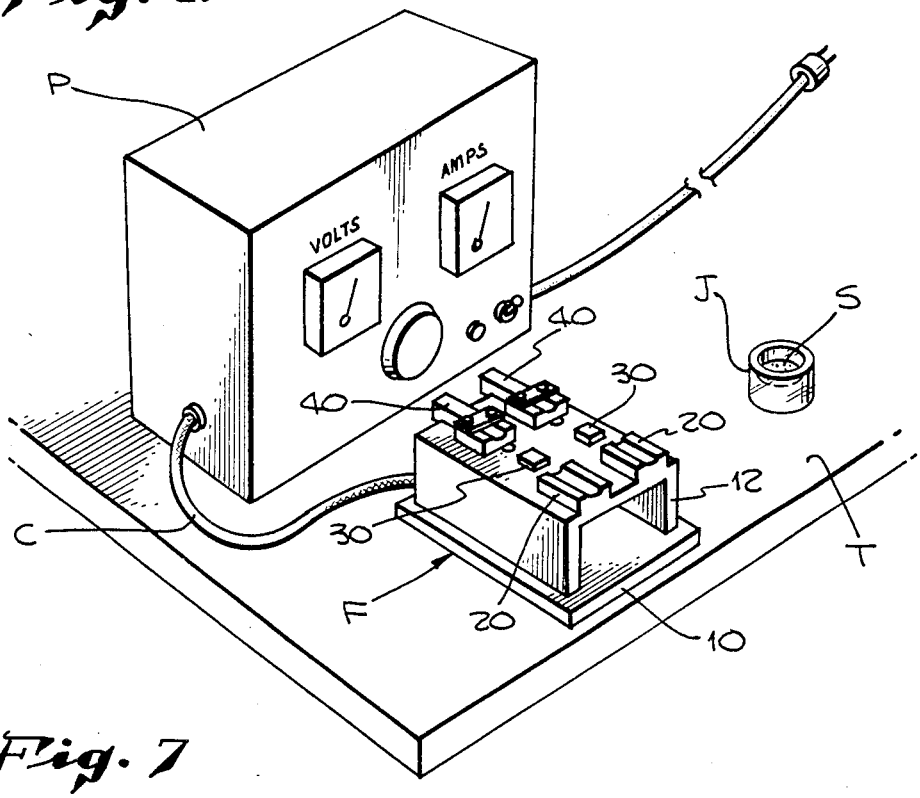
FIG. 1 is a perspective view of one form of apparatus in accordance with the invention, including two separate plating fixtures shown in an outline form.

Referring to FIG. 1, a power unit P and a plating fixture F are supported on a table top T. A cable C supplies D.C. power from the power unit to the plating fixture. A small jar J that also rests upon the table top contains a plating solution S. The present invention utilizes a type of plating that is generally known in the industry as brush plating. See, for example, U.S. Pat. No. 4,385,968.

Plating fixture F includes a flat base plate 10 and an inverted U-shaped base member 12. Member 12 is firmly secured on top of the plate 10. A pair of forward anode support blocks 20 are located on the upper surface of the forward end of member 12 and are formed integral therewith. In the central part of member 12 are a pair of cathode support posts 30. A pair of rear anode support carriages 40 are located on the rearward end of member 12.

Figure 2:
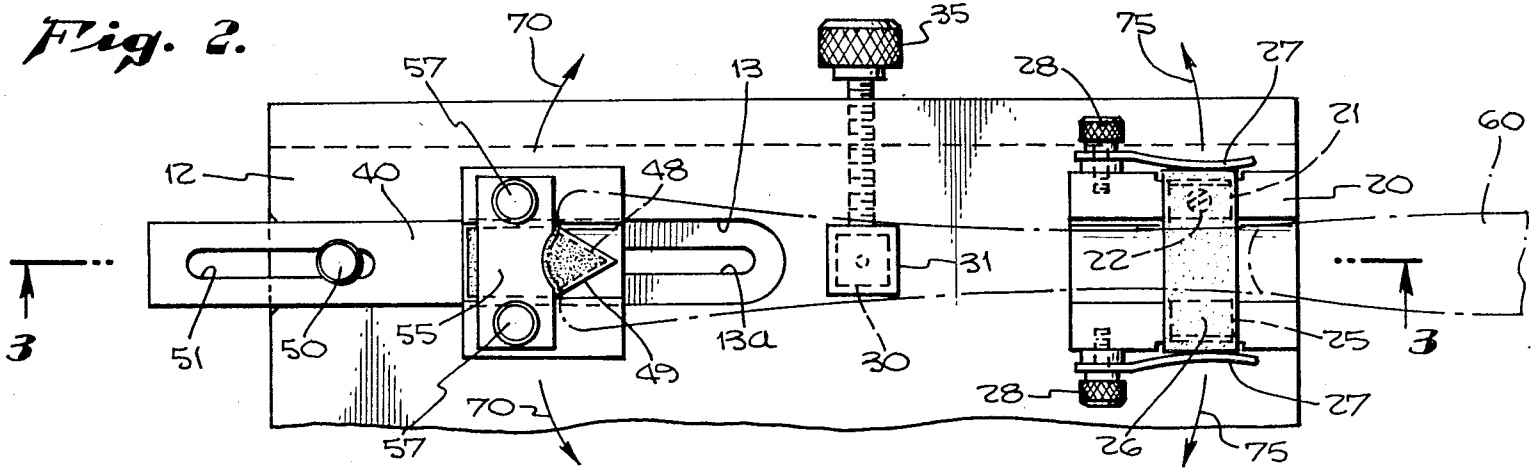
FIG. 2 is a top plan view of one plating fixture, showing in dotted lines a knife positioned thereon.
Figure 3:
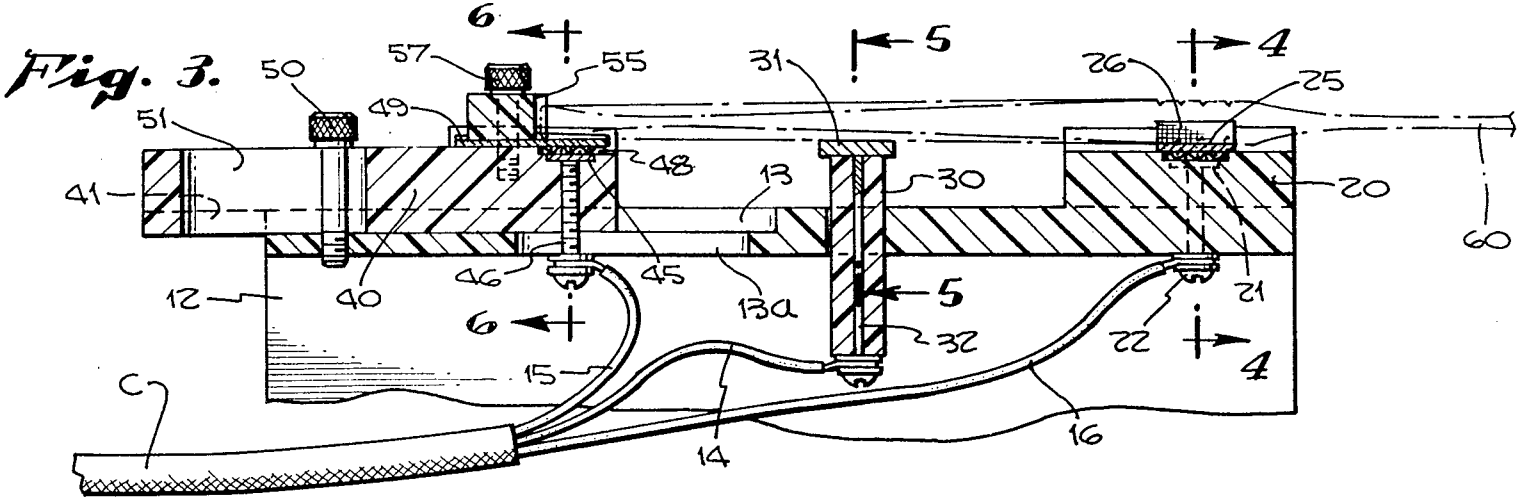
FIG. 3 is a cross-sectional elevation view taken on the line 3—3 of FIG. 2.
Figure 4:
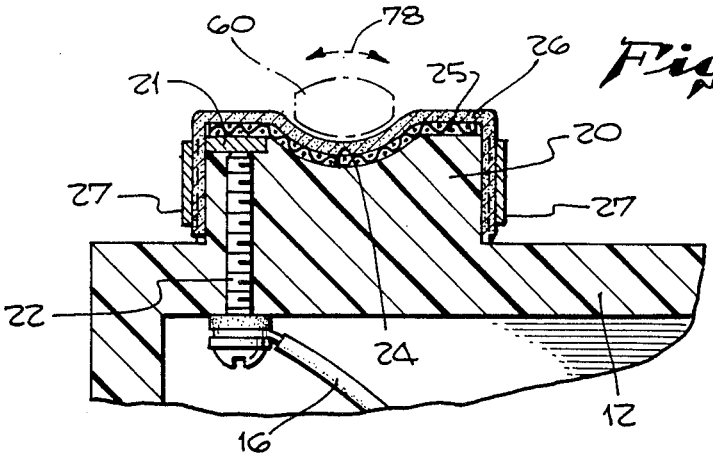
FIG. 4 is a cross-sectional elevation view taken on the line 4—4 of FIG. 3.

The base member 12, as well as base plate 10, is made of a rigid plastic material which is an electrical insulator, as clearly seen in the cross-section views of FIGS. 3–6. Thus, forward support blocks 20 are made of the same material. Reference is now made to FIGS. 2–4 which illustrate the details of the forward anode structure.

As shown in FIG. 3 the cable C provides a single negative or cathode wire 14 and a pair of positive or anode wires 15, 16. Anode wire 16 goes to the forward anode structure. A small metal plate 21 is secured to the upper surface of block 20. A metal machine screw 22 has its head disposed downward and a contact terminal of the anode wire 16 secured to it, the body of the screw extending upward through a hole formed in the block 20 so that its upper end is in firm conductive engagement with the plate 21. A wire mesh screen 25 lies across the upper surface of block 20 and is therefore in conductive engagement with the cathode plate 21. An absorbent pad 26 lies across the top of screen 25, having also protruding ends which extend down the respective sides of block 20, see FIG. 4. The ends of pad 26 are held in place by respective spring clamps 27, which may be selectively tightened or released by their respective holding screws 28.

Thus, during use of fixture F, absorbent pad 26 and wire mesh screen 25 may be filled with the plating solution S which will then complete the electrical circuit through the anode wire 16 to an object to be plated which is received by the plating fixture and resting upon the pad 26.

Figure 5:
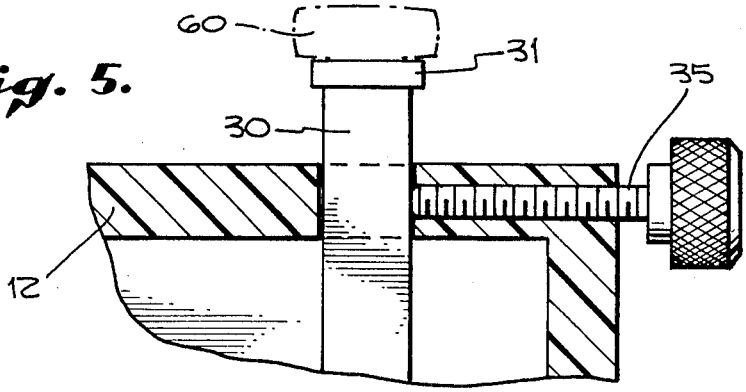
FIG. 5 is a cross-sectional elevation view taken on the line 5—5 of FIG. 3.

FIGS. 2, 3 and 5 show the structural arrangement of the vertically adjustable cathode support post 30. Post 30 has a generally square cross-sectional configuration and extends upward through a centrally located square hole in the base member 12. A horizontal set screw 35, FIG. 5, extends through a threaded opening in one side of member 12 and serves to hold the post 30 in a selected position of vertical adjustment. A metal cathode plate 31 is attached on the upper end of post 30 in a horizontal position. A metal screw 32, FIG. 3, has its head downwardly disposed and attached to a metal contact terminal on cathode wire 14, the screw then extending vertically upward through a round hole in post 30 and having its upper end conductively attached to the cathode plate 31. Thus the cathode plate 31 may be adjusted vertically as necessary in order to provide good electrical conductivity between cathode wire 14 and the article being plated.

Figure 6:
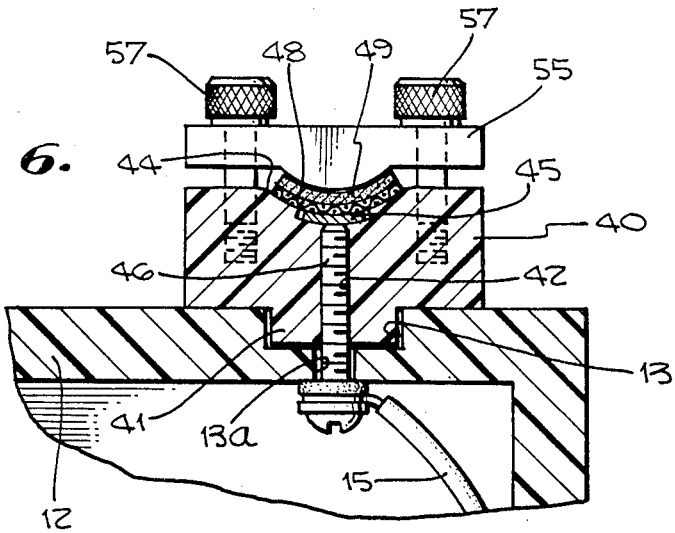
FIG. 6 is a cross-sectional elevation view taken on the line 6—6 of FIG. 3.

The rear anode support carriage 40 is shown in FIGS. 2, 3 and 6. A longitudinal groove 13 is cut in the upper surface of the rearward end of base member 12. At the transverse center of groove 13 the member 12 is slotted at 13*a*. Carriage 40 is in the form of a generally rectangular block having a downwardly extending tongue 41 which occupies the groove 13. There is also a vertical hole 42 through block 40, FIG. 6. A metal anode plate 45 rests on the upper surface of block 40. A metal screw 46 has its head end conductively attached to anode wire 15 while its body extends upward through the hole 42 in block 40 with its upper end conductively secured to the anode plate 45. Thus, positive voltage from power unit P is applied to anode plate 45 as well as to the anode plate 21.

A metal mesh screen 48 rests on the top of anode plate 45, and an absorbent pad 49 rests on the mesh screen 48. The pad and the mesh screen can be filled with plating solution in order to complete the electrical circuit between power unit P and an article to be plated.

It will be noted that the upper surface of forward anode block 20 is concavely curved at 24. In similar fashion, the upper surface of rear anode carriage 42 is curved concavely at 44. These concave surfaces perform two separate and distinct functions. One function is to assist in retaining a certain amount of the plating solution S within the wire mesh screen and absorbent pad of each anode assembly, to minimize loss of the solution and at the same time assure good electrical continuity. The second function is to act as a guide means for guiding the particular article to be plated into an aligned position on the plating fixture in which it will conductively engage all of the electrodes on the fixture.

As shown in FIGS. 2 and 3, carriage 40 at its rearward end has a longitudinal slot 51 which receives an adjusting screw 50, for securing the carriage in a desired position of longitudinal adjustment in which it has a desired horizontal spacing from the forward anode assembly. The rear anode assemby also includes a clamping block 55 with clamping screws 57 for holding the rearward ends of mesh screen 48 and absorbent pad 49 in a clamped down position on carriage block 40.

THE METHOD

Figure 7:
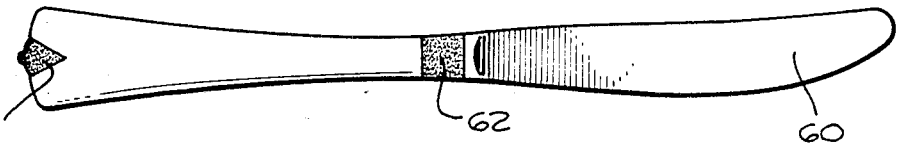
FIG. 7 is a plan view of a knife which has been spot plated in accordance with the invention.

The method of the invention is illustrated with respect to a knife 60, FIG. 7, having one ornamental surface area 61 on its handle end and another ornamental surface area 62 in its central portion adjacent the cutting blade. Knife 60 is shown in dotted lines in FIGS. 2–4. Since fixture F has duplicate mechanisms for receiving two articles simultaneously, it will be understood that two knives may be plated at the same time.

The absorbent pads of both anodes are filled with plating solution, typically an aqueous gold cyanide solution that is commercially available. The power P is turned on, providing a voltage in the order of 4 volts D.C. Then the knife is placed in the fixture in the horizontal position as shown in FIGS. 2 and 3. With proper adjustment of the cathode and of the rear anode assembly, contact is made by all three electrodes, and current flows from both anodes through the knife and into the cathode. After a predetermined period of time the knife is removed from the fixture and washed in a wash vessel, not shown, to remove any excess plating solution.

According to the preferred method of the invention a fast plating solution is used in order to speed up the process. It is then greatly preferred, and perhaps essential, to horizontally reciprocate the article being plated. This is preferably done by rotating the knife about a vertical axis passing through the cathode plate. The two ends of the knife then move through arcuate paths as shown by arrows 70, 75 in FIG. 2 and arrows 78 in FIG. 4.

Figure 8:
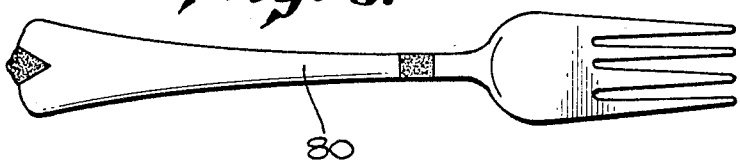
FIG. 8 is a plan view of a fork which has been spot plated in accordance with the invention.
Figure 9:
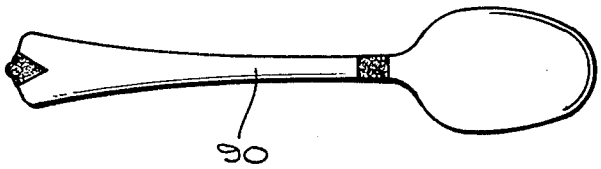
FIG. 9 is a plan view of a spoon which has been spot plated in accordance with the invention.

Application of the invention in spot plating a fork 80, FIG. 8, or a spoon 90, FIG. 9, will be evident from the foregoing description, although it will require a different adjustment of the rear anode carriage and possibly of the cathode post as well.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. The method of spot gold plating a metallic flatware article, comprising the steps of:

(a) selecting the flatware article to be plated;

(b) selecting a plating fixture having at least one upwardly facing metallic cathode and at least one upwardly facing metallic mesh anode for supporting the flatware article in a horizontal position, and guide means for aligning the flatware article in a predetermined position relative to said cathode and anode;

(c) selecting an aqueous gold plating solution adapted for brush plating;

(d) filling the metallic mesh anode with the plating solution;

(e) applying a D.C. voltage between said anode and said cathode;

(f) then placing the article of flatware on the fixture for a predetermined period of time so as to spot gold plate its surface area that is in contact with the anode; and (g) then removing the article from the fixture and washing off any excess plating solution.

2. The method of claim 1 which includes the additional step of imparting a reciprocating horizontal movement to the article of flatware while it is in contact with the anode so as to speed up the brush plating action that is accomplished by the metallic mesh anode.

* * * * *